US005638556A

United States Patent [19]

Kipers et al.

[11] Patent Number: 5,638,556

[45] Date of Patent: Jun. 17, 1997

[54] FLOATING SWIMMING POOL APPARATUS

[76] Inventors: Thomas Morgan Kipers; Deborah Ann Kipers, both of 908 Lido Cir., Discovery Bay, Calif. 94514

[21] Appl. No.: 419,731

[22] Filed: Apr. 10, 1995

[51] Int. Cl.[6] ..... E04H 4/00

[52] U.S. Cl. ..... 4/488

[58] Field of Search ..... 4/487, 488, 495, 4/505

[56] References Cited

U.S. PATENT DOCUMENTS

| | | | |
|---|---|---|---|
| 1,925,175 | 9/1933 | Day | 4/487 |
| 3,026,538 | 3/1962 | Boyd et al. | 4/487 |
| 3,078,472 | 2/1963 | Salisbury | 4/487 |
| 3,555,575 | 1/1971 | Schwartz et al. . | |
| 3,602,925 | 9/1971 | Thompson | 4/487 |
| 3,962,735 | 6/1976 | Davidson | 4/505 |
| 4,087,870 | 5/1978 | Palmer, Jr. . | |
| 4,135,256 | 1/1979 | Limegrover . | |
| 4,145,770 | 3/1979 | Zaris | 4/487 X |
| 4,149,281 | 4/1979 | Bob et al. | 4/487 |
| 4,152,791 | 5/1979 | Rose | 4/487 |
| 4,706,307 | 11/1987 | Smith . | |

*Primary Examiner*—Charles E. Phillips

[57] ABSTRACT

A floating swimming pool apparatus includes a rigid water retaining portion which includes rigid walls and a rigid floor. A peripheral deck portion is connected to top portions of the rigid walls, and a plurality of individually adjustable drum-like container are connected to the deck portion. Each of the drum-like containers includes a fill port through which a quantity of ballast material can be added to or removed from the drum-like container. The preferred ballast material is water. A layer of flotation foam material attached to exterior surfaces of the rigid walls and the rigid floor of the water retaining portion. Inner joists are connected to the deck portion proximal to the rigid walls of the water retaining portion. Outer joists are connected to the deck portion distal to the rigid walls of the water retaining portion. Each of the adjustable drum-like flotation assemblies is suspended from the deck portion by a suspension band connected to a respective inner joist and a respective outer joist. First strut assemblies are connected to the rigid walls and are coextensive with portions of the rigid walls. Second strut assemblies are connected between the first strut assemblies and the outer joists. The adjustable flotation assemblies and the second strut assemblies are arrayed along the rigid walls in alternating fashion and are spaced sufficiently close to one another longitudinally to prevent the adjustable drum-like flotation assemblies from sliding longitudinally out of contact with the suspension bands.

10 Claims, 3 Drawing Sheets

FIG 1
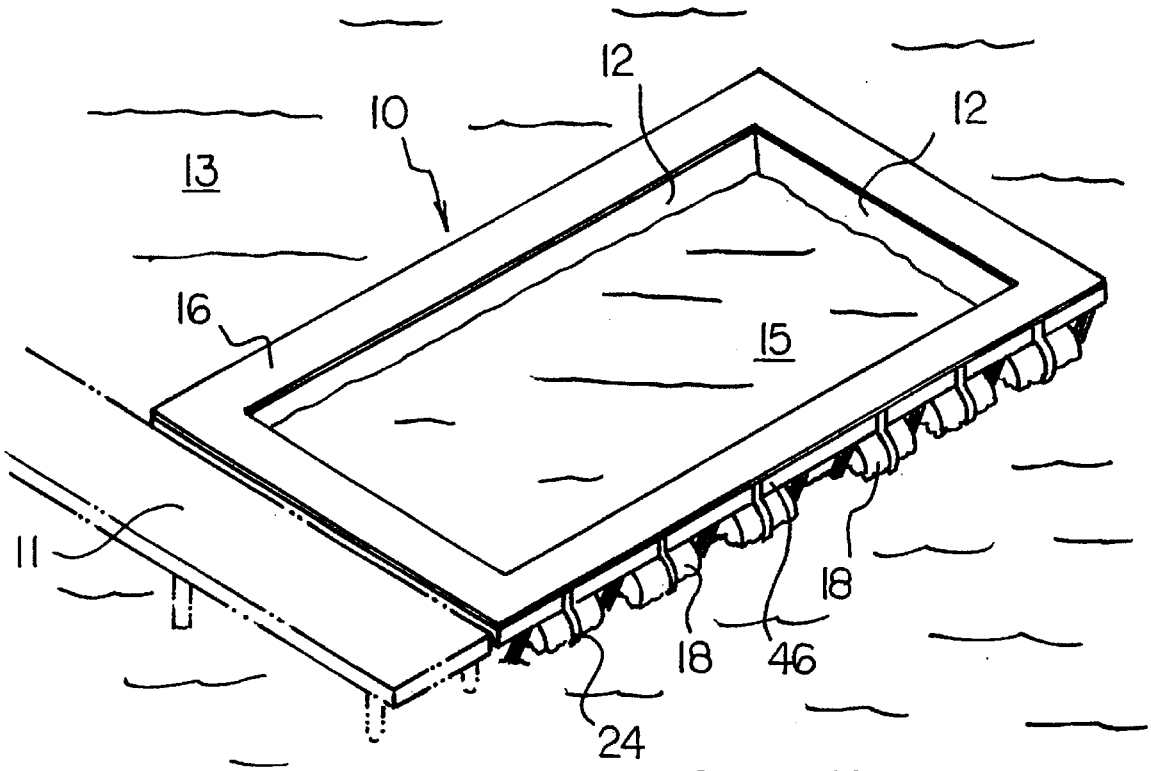
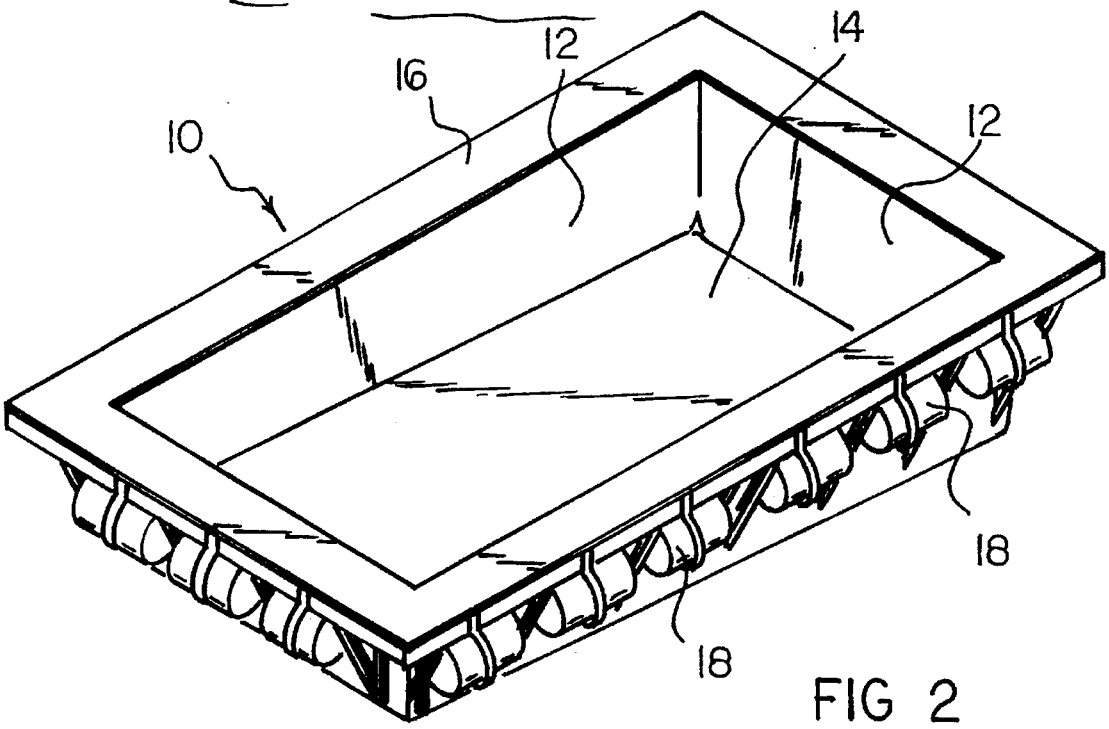
FIG 2

FIG 3
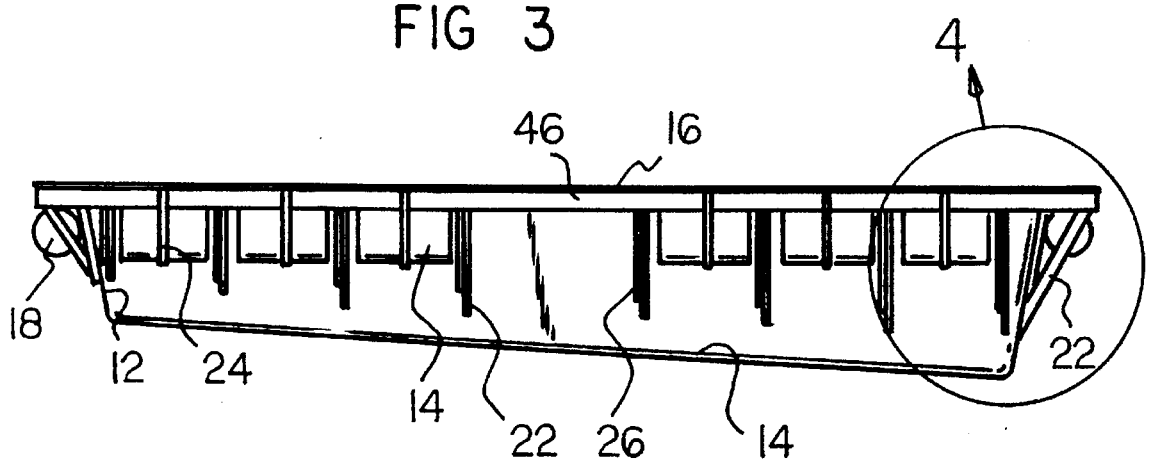
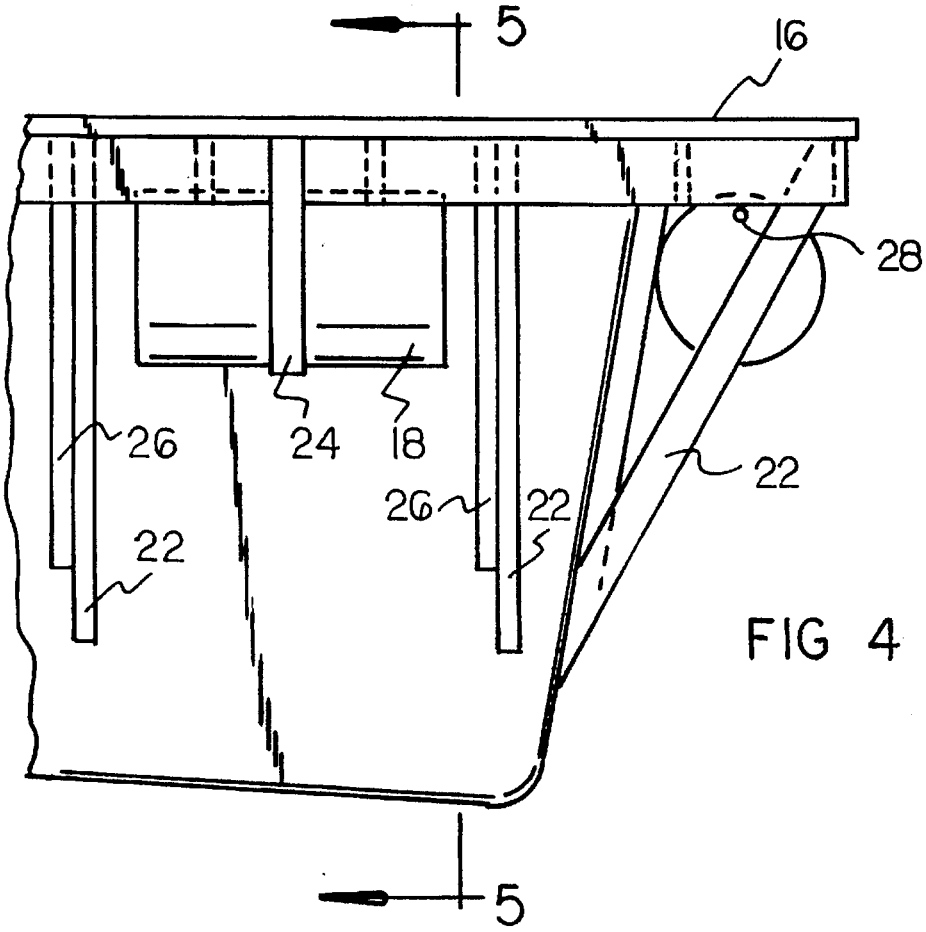
FIG 4

FLOATING SWIMMING POOL APPARATUS

BACKGROUND OF THE INVENTION

1. Field of the Invention

The present invention relates generally to swimming pools and, more particularly, to swimming pools especially adapted to float in a body of water.

2. Description of the Prior Art

Floating swimming pools are known in the art as exemplified by the following U.S. patents: U.S. Pat. Nos. 3,602,925; 4,087,870; 4,135,256; and 4,706,307. Of interest, U.S. Pat. No. 3,555,575 discloses a modular swimming pool that is designed to be used with a ground installation. There are certain features that would be desirable in a floating swimming pool that are not present in the prior art floating swimming pools. For example, to provide enhanced stability, it would be desirable if a floating swimming pool had a completely rigid water retaining portion. The prior art floating swimming pools disclose water retaining portions that have one or more flexible walls. To provide greater flotation ability to the water retaining portion, it would be desirable if the exterior surfaces of the walls were covered with a buoyant material.

The prior art floating swimming pools disclose devices that provide flotation for the water retaining portion and deck adjacent to the water retaining portion. The flotation devices provided by the prior art appear to be single-chamber devices that are coextensive with the perimeter of the water retaining portion. As a result, flotation forces are distributed evenly around the periphery of the water retaining portion. Such an even peripheral distribution of flotation forces may not be desirable in view of the fact that the weight of the floating swimming pool is not evenly distributed throughout the floating swimming pool. More specifically, in a floating swimming pool that has a water retaining portion of varying depth, the walls located in the deep end of the water retaining portion are longer than the walls located in the shallow end of the water retaining portion. As a result, the deep side of the water retaining portion has greater weight than the shallow side. Therefore, in order to provide a floating swimming pool that is not tilted in the water, the deeper side should have greater flotation forces than the shallow side. Generally, then, it would be desirable if a floating swimming pool had a way to provide adjustable flotation forces around the periphery of the floating swimming pool.

A floating swimming pool has both a water retaining portion and a peripheral deck on which persons can walk. It is essential that the deck be firmly secured to the water retaining portion. In this respect, it would be desirable if a simple and inexpensive way were provided to strongly secure a deck to a water retaining portion in a floating swimming pool.

Thus, while the foregoing body of prior art indicates it to be well known to use floating swimming pools, the prior art described above does not teach or suggest a floating swimming pool apparatus which has the following combination of desirable features: (1) has a completely rigid water retaining portion; (2) has exterior wall surfaces which are covered with a buoyant material; (3) provides adjustable flotation forces around the periphery of the floating swimming pool; and (4) provides a simple and inexpensive way to strongly secure a deck to a water retaining portion.

The foregoing desired characteristics are provided by the unique floating swimming pool apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a floating swimming pool apparatus which includes a rigid water retaining portion which includes rigid walls and a rigid floor. A peripheral deck portion is connected to top portions of the rigid walls, and a plurality of individually adjustable flotation assemblies are connected to the deck portion.

The individually adjustable flotation assemblies are comprised of individually adjustable drum-like containers. Each of the drum-like containers includes a fill port through which a quantity of ballast material can be added to or removed from the drum-like container. The preferred ballast material is water.

A layer of flotation material attached to exterior surfaces of the rigid walls and the rigid floor of the water retaining portion.

Inner joists are connected to the deck portion proximal to the rigid walls of the water retaining portion. Outer joists are connected to the deck portion distal to the rigid walls of the water retaining portion. Each of the adjustable flotation assemblies is suspended from the deck portion by a suspension band connected to a respective inner joist and a respective outer joist.

First strut assemblies are connected to the rigid walls and are coextensive with portions of the rigid walls. Second strut assemblies are connected between the first strut assemblies and the outer joists. The adjustable flotation assemblies and the second strut assemblies are arrayed along the rigid walls in alternating fashion. The adjustable flotation assemblies and the second strut assemblies are spaced sufficiently close to one another longitudinally to prevent the adjustable flotation assemblies from sliding longitudinally out of contact with the suspension bands. Transverse brace elements are connected between the inner joists and the outer joists.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved floating swimming pool apparatus which has all of the advantages of the prior art and none of the disadvantages.

It is another object of the present invention to provide a new and improved floating swimming pool apparatus which may be easily and efficiently manufactured and marketed.

It is a further object of the present invention to provide a new and improved floating swimming pool apparatus which is of durable and reliable construction.

An even further object of the present invention is to provide a new and improved floating swimming pool apparatus which is susceptible of a low cost of manufacture with regard to both materials and labor, and which accordingly is then susceptible of low prices of sale to the consuming public, thereby making such floating swimming pool apparatus available to the buying public.

Still yet a further object of the present invention is to provide a new and improved floating swimming pool apparatus which has a completely rigid water retaining portion.

Still another object of the present invention is to provide a new and improved floating swimming pool apparatus that has exterior wall surfaces which are covered with a buoyant material.

Yet another object of the present invention is to provide a new and improved floating swimming pool apparatus which provides adjustable flotation forces around the periphery of the floating swimming pool.

Even another object of the present invention is to provide a new and improved floating swimming pool apparatus that provides a simple and inexpensive way to These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the floating swimming pool apparatus of the invention floating in a body of water, retaining a quantity water in the water retaining portion, and associated with a dock.

FIG. 2 is an enlarged perspective view of the embodiment of the invention shown in FIG. 1 removed from the body of water, drained of retained water, and disassociated from the dock.

FIG. 3 is a side view of the embodiment of the floating swimming pool apparatus of FIG. 2.

FIG. 4 is an enlarged side view of the encircled portion 4 of the embodiment of the invention shown in FIG. 3.

DESCRIPTION OF THE PREFERRED EMBODIMENT

Figures 5, 6:
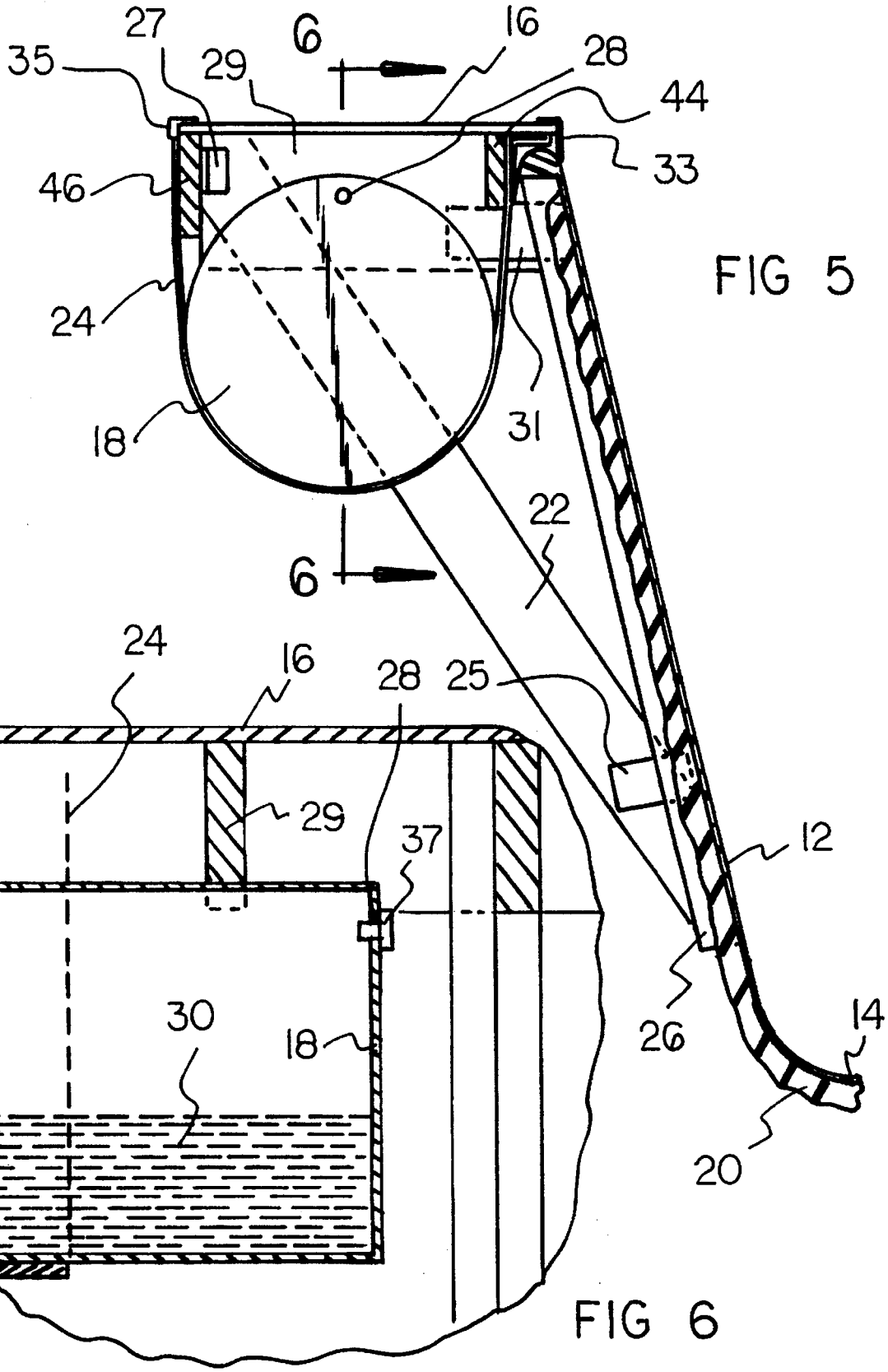
FIG. 5 is an enlarged cross-sectional view of the embodiment of the invention shown in FIG. 4 taken along line 5—5 of FIG. 4.
FIG. 6 is an enlarged cross-sectional view of the embodiment of the invention shown in FIG. 5 taken along line 6—6 of FIG. 5.

With reference to the drawings, a new and improved floating swimming pool apparatus embodying the principles and concepts of the present invention will be described.

Turning to FIGS. 1–6, there is shown an exemplary embodiment of the floating swimming pool apparatus of the invention generally designated by reference numeral 10. In its preferred form, floating swimming pool apparatus 10 includes a rigid water retaining portion which includes rigid walls 12 and a rigid floor 14. A peripheral deck portion 16 is connected to top portions of the rigid walls 12, and a plurality of individually adjustable flotation assemblies 18 are connected to the deck portion 16. The rigid water retaining portion contains a quantity of pool water 15. The rigid walls 12 form a four-walled water retaining portion whose adjacent walls are connected at right angles to each other. The deck portion 16 is in the form of a rectangular frame connected to the four rigid walls 12.

The individually adjustable flotation assemblies 18 are comprised of individually adjustable drum-like containers 18. Each of the drum-like containers 18 includes a fill port 28 through which a quantity of ballast material 30 can be added to or removed from the drum-like container 18. The preferred ballast material 30 is water.

A layer of flotation material 20 is attached to exterior surfaces of the rigid walls 12 and the rigid floor 14 of the water retaining portion. The layer of flotation material 20 can be made of a foam material. The foam material reduces heat loss from the water retaining portion to the surrounding body of water 13, thereby reducing energy costs. The foam material provides significant buoyancy to the floating swimming pool apparatus 10.

Inner joists 44 are connected to the deck portion 16 proximal to the rigid walls 12 of the water retaining portion. Outer joists 46 are connected to the deck portion 16 distal to the rigid walls 12 of the water retaining portion. Each of the adjustable flotation assemblies 18 is suspended from the deck portion 16 by a suspension band 24 connected to a respective inner joist 44 and a respective outer joist 46.

First strut assemblies 26 are connected to the rigid walls 12 and are coextensive with portions of the rigid walls 12. Second strut assemblies 22 are connected between the first strut assemblies 26 and the outer joists 46. Substantially triangular support structures are formed by the first strut assemblies 26, the second strut assemblies 22, and the deck portion 16. First angle irons 25 are used to connect the first strut assemblies 26 to the second strut assemblies 22. Second angle irons 27 are used to connect the second strut assemblies 22 to the outer joists 46.

The adjustable flotation assemblies 18 and the second strut assemblies 22 are arrayed along the rigid walls 12 in alternating fashion. The adjustable flotation assemblies 18 and the second strut assemblies 22 are spaced sufficiently close to one another longitudinally to prevent the adjustable flotation assemblies 18 from sliding longitudinally out of contact with the suspension bands 24. In this respect, the second strut assemblies 22 serve to retain the adjustable flotation assemblies 18 on the suspension bands 24.

Transverse brace elements 29 are connected between the inner joists 44 and the outer joists 46. Third angle irons 31 are used to connect the transverse brace elements 29 to the first strut assemblies 26.

In using the floating swimming pool apparatus 10 of the invention, the floating swimming pool apparatus 10 may be tied up to a dock 11, moored to pilings, retained by anchors or other suitable in a body of water 13 for the purpose of swimming. The water in the floating swimming pool apparatus 10 may be heated, filtered, chlorinated, covered, and lighted just as with a ground-supported pool. Just as with a ground-supported pool, the floating swimming pool apparatus 10 of the invention can have pool steps. It is noted that in FIG. 3, the far left rigid wall 12 is shallower than the far right rigid wall 12. As a result, the rigid floor 14 is sloped downward from the left side to the fight side of FIG. 3. In this respect, the shallow end of the pool is on the left side of FIG. 3, and the deep end of the pool is on the fight side of FIG. 3.

As described above, the deck portion 16 of the floating swimming pool apparatus 10 is connected to the water retaining portion by angle iron connections. More specifically, first angle irons 25 connect the second strut assemblies 22 to the first strut assemblies 26 which are connected to the rigid walls 12. Portions of the layer of flotation material 20 can be sandwiched between the first strut assemblies 26 and the rigid walls 12. Second angle irons 27 are used to connect the second strut assemblies 22 to the outer joists 46 which are connected to the deck portion 16. The transverse brace elements 29 are connected to the outer joists 46 and to the inner joists 44 by suitable angle irons (not shown), and the third angle irons 31 are used to connect the transverse brace elements 29 to the first strut assemblies 26. It is understood that suitable fasteners, such as nuts and bolts, nails, screws or the like, are used to connect the respective angle irons to the respective elements to which the angle irons are attached.

The deck portion 16 is used to gain access around the water retaining portion of the floating swimming pool apparatus 10 from the mooring or dock 11. Moreover, the deck portion 16 also provides extra stability for the rigid walls 12 and the top edges of the rigid walls 12. The deck portion 16 and the adjustable flotation assemblies 18 are very important in providing stability to the floating swimming pool apparatus 10 while floating in the body of water 13. This reduces pitching, rolling, and yawing of the floating swimming pool apparatus 10. The deck portion 16 also has inner trim 33 applied to the inner edge of the deck portion 16 and outer trim 35 applied to the outer edge of the deck portion 16.

Standard industry plumbing can be used to hook up the floating swimming pool apparatus 10 of the invention to the facilities on the dock 11.

To adjust the tilt of the floating swimming pool apparatus 10 in the body of water 13, the individual adjustable flotation assemblies 18 are adjusted. That is, for each of the adjustable flotation assemblies 18. A plug 37 is removed from the fill port 28. Then, the quantity of water ballast 30 is adjusted by either adding water or sucking out or draining water from the adjustable flotation assemblies 18. When ballast water 30 is added, the buoyancy of the respective adjustable flotation assembly 18 is decreased. When ballast water 30 is removed, the buoyancy of the respective adjustable flotation assembly 18 is increased.

The components of the floating swimming pool apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved floating swimming pool apparatus that is low in cost, relatively simple in design and operation, and which provides a completely rigid water retaining portion. With the invention, a floating swimming pool apparatus is provided which has exterior wall surfaces which are covered with a buoyant material. With the invention, a floating swimming pool apparatus provides adjustable flotation forces around the periphery of the floating swimming pool. With the invention, a floating swimming pool apparatus provides a simple and inexpensive way to strongly secure a deck to a water retaining portion.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A floating swimming pool apparatus, comprising:

a rigid water retaining portion which includes rigid walls and a rigid floor, a peripheral deck portion connected to top portions of said rigid walls, and a plurality of individual flotation assemblies connected to said deck portion, each of said individual floatation assemblies having means for adjusting the buoyancy thereof, respectively, said apparatus further including:

inner joists connected to said deck portion proximal to said rigid walls of said water retaining portion, and outer joists connected to said deck portion distal to said rigid walls of said water retaining portion, first strut assemblies connected to said rigid walls and coextensive with portions of said rigid walls, and second strut assemblies connected between said first strut assemblies and said outer joists.

2. The apparatus of claim 1 wherein each individual flotation assembly is comprised of a drum-like container.

3. The apparatus of claim 1 wherein each of said drum-like containers includes a fill port through which a quantity of ballast material can be added to or removed from said drum-like container.

4. The apparatus of claim 3 wherein said ballast material is water.

5. The apparatus of claim 1, further including:

a layer of flotation material attached to exterior surfaces of said rigid walls and said rigid floor of said water retaining portion.

6. The apparatus of claim 1, further including:

inner joists connected to said deck portion proximal to said rigid walls of said water retaining portion, and outer joists connected to said deck portion distal to said rigid walls of said water retaining portion.

7. The apparatus of claim 6 wherein each of said individual flotation assemblies is suspended from said deck portion by a suspension band connected to a respective inner joist and a respective outer joist.

8. The apparatus of claim 7, further including:

transverse brace elements connected between said inner joists and said outer joists.

9. The apparatus of claim 8 wherein said individual flotation assemblies and said second strut assemblies are arrayed along said rigid walls in alternating fashion.

10. The apparatus of claim 9 wherein said individual flotation assemblies and said second strut assemblies are spaced sufficiently close to one another longitudinally to prevent said individual flotation assemblies from sliding longitudinally out of contact with said suspension bands.

* * * * *